US005976033A

United States Patent [19]

Takeda

[11] Patent Number: 5,976,033

[45] Date of Patent: Nov. 2, 1999

[54] GOLF CLUB

[75] Inventor: Hitoshi Takeda, Tsubame, Japan

[73] Assignee: Kabushiki Kaisha Endo Seisakusho, Niigata-Ken, Japan

[21] Appl. No.: 09/133,723

[22] Filed: Aug. 13, 1998

[30] Foreign Application Priority Data

Nov. 27, 1997 [JP] Japan ..... 9-326637

[51] Int. Cl.[6] ..... A63B 53/04

[52] U.S. Cl. ..... 473/334; 473/338; 473/349

[58] Field of Search ..... 473/324, 334, 473/335, 336, 338, 337, 339, 345, 346, 349, 256, 328, 219, 226, 228, 291

[56] References Cited

U.S. PATENT DOCUMENTS

| | | |
|---|---|---|
| 1,538,312 | 5/1925 | Beat . |
| 2,225,930 | 12/1940 | Sexton . |
| 2,257,575 | 9/1941 | Reach . |
| 2,756,055 | 7/1956 | Bittner . |
| 4,602,787 | 7/1986 | Sugioka . |
| 4,708,347 | 11/1987 | Kobayashi . |
| 4,775,156 | 10/1988 | Thompson . |
| 4,795,159 | 1/1989 | Nagamoto . |
| 4,884,808 | 12/1989 | Retzer . |

FOREIGN PATENT DOCUMENTS

| | | |
|---|---|---|
| 7-112042 | 5/1995 | Japan . |

*Primary Examiner*—Sebastiano Passaniti
*Attorney, Agent, or Firm*—Quarles & Brady LLP

[57] ABSTRACT

A golf club with less limitations to materials usable for a balance weight on a outer face of a sole, having a structure for the balance weight to be easily fixed to a head body. A hollow head body 16 of a long iron has an outer shell formed with a through-hole 21, corresponding to the sole 4 portion. A projection 34 is formed on an upper face of the balance weight 31 so that the projection 34 is inserted into the through-hole 21. Another through-hole 35 is formed in the projection 34, into which is pressed a taper pin 36 to be anchored there. As a result, the balance weight 31 is securely fixed to the head body 16. Unlike the fixing by caulking a balance weight itself, the invention does not need the extensibility of the material of the weight 31. Accordingly, tungsten-based materials, for example, are also made usable.

5 Claims, 6 Drawing Sheets

GOLF CLUB

BACKGROUND OF INVENTION

1. Field of Invention

The present invention relates to a golf club, particularly to its structure for securing a balance weight thereto.

2. Prior Art

It is a known art to provide a golf club head with a balance weight secured to a sole. FIG. 4 through FIG. 6 illustrate one example of such conventional golf club head 1, which is a long iron club in this example. The head 1 is hollow and metallic, having a face 2 at its front side, a back 3 at its back side, a sole 4 at its lower side, a top 5 at its upper side, a heel 6 at its proximal side and a toe 7 at its distal side, respectively. The heel 6 is formed with a neck 8, from which extends upwardly a hosel 9. The hosel 9 serves as a shaft connector for connecting a shaft 10 thereto. Incidentally, a plurality of nearly horizontal concave grooves 11, which are called score lines, are formed on said face 2.

The head body 16 forming the majority portion of said head 1 is constructed by for example joining a plurality of metallic plate members together by welding or the like, said metallic plate members being forged for example, so that it is made hollow thereinside. A plurality of metallic balance weights 17 are fixed securely to the outer surface of the sole 4 of the head body 16, projecting downward therefrom. While the material of said head body 16 is either iron-based or titanium-based, the material of each balance weight 17 is beryllium copper for example, so that the specific gravity of the latter is larger than that of the former.

In other words, one of the objects of the balance weight 17 is to lower the center of gravity of the whole head 1. With the center of gravity thus lowered, balls are made easier to raise when they are struck, thus resulting in elongated travelling distances thereof. On the other hand, each balance weight 17 is formed slender, elongated in the back-to-front direction, having beveled portions 18 on its lower face on all sides, and thus, it is another object of the balance weight 17 to reduce a contacting area with the ground at the time of striking balls so as to lessen the resistance of the head 1 against the ground.

Whereas, there is illustrated in FIG. 6 a conventional method of fixing the balance weight 17 to the head body 16. According to the conventional method, a through-hole 21 is defined through an outer shell corresponding to the sole 4 of the head body 16, into which is inserted a projection 22 formed on an upper face of the balance weight 17, as illustrated in FIG. 6A. Thereafter, the projection 22 is caulked using a press device or the like in order to form a caulked portion 23, thereby fixing the balance weight 17 to the head body 16, as illustrated in FIG. 6B. It is to be noted that the caulked portion 23 is located inside the head 1, when the head 1 is finished. Incidentally, reference numeral 24 indicated in FIGS. 6A and 6B designates a weight plate provided on an inner face of the outer shell, corresponding to the sole 4 of the head body 16.

According to the conventional fixing method using caulking, however, there are limitations to the materials which can be used for the balance weight 17. Materials with less extensibility are unsuitable for caulking. Taking tungsten for example, it has insufficient extensibility, and unsuitable for caulking, although it is suitable as a material for a balance weight due to its relatively large specific gravity.

SUMMARY OF THE INVENTION

To eliminate the above problems, it is, therefore, an object of the invention to provide a golf club whose balance weight suffers from less limitations to the materials usable therefor, and is able to be easily fixed to the head body.

To attain the above object, there is provided a golf club incorporating a head having a shaft connected thereto and a face on a front, said head comprising: a hollow head body, having an outer shell formed with a through-hole; a balance weight to be securely fixed to an outer face of said head body, having a projection formed therewith, said projection having a through-hole; and a taper wedge member, wherein said projection of the balance weight is inserted into said through-hole of the head body, and then said taper wedge member is pressed into the through-hole of said balance weight so as to securely fix the balance weight to the head body.

BRIEF DESCRIPTION OF THE DRAWINGS

Other objects, features and advantages of the invention will be apparent to those skilled in the art from the following description of the preferred embodiments of the invention, wherein reference is made to the accompanying drawings, of which.

DETAILED DESCRIPTION OF THE PREFERRED EMBODIMENTS

Figure 1:
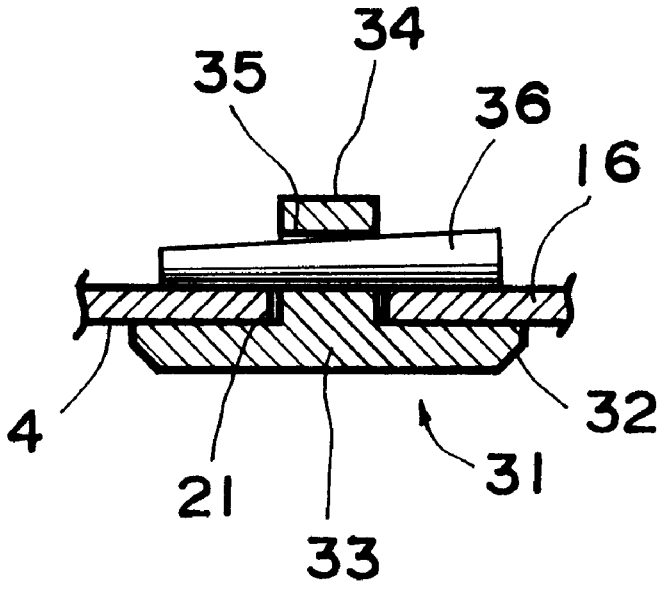
FIG. 1 is a longitudinal section showing the vicinity of a balance weight of an embodiment of a golf club of the invention.
Figure 2A:
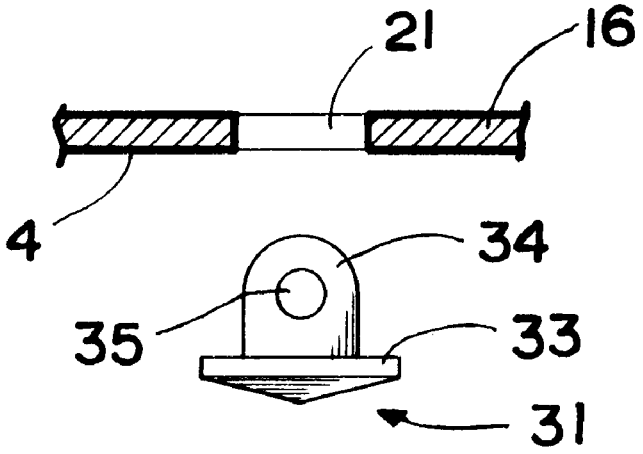
FIG. 2A is a transverse section of the vicinity of a balance weight of the embodiment prior to fixing the balance weight, while FIG. 2B a transverse section thereof after fixing the same.
Figure 2B:
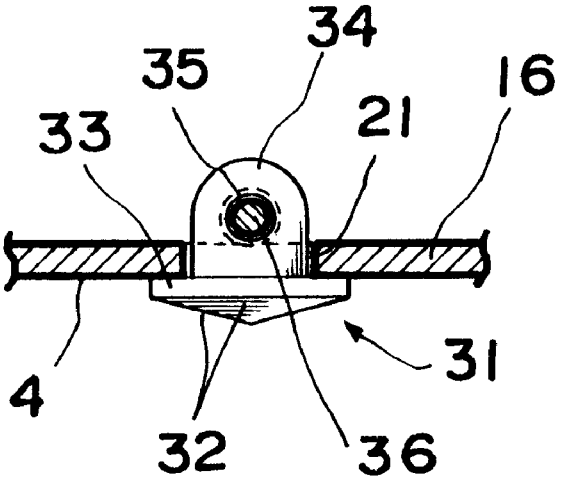
Figure 3:
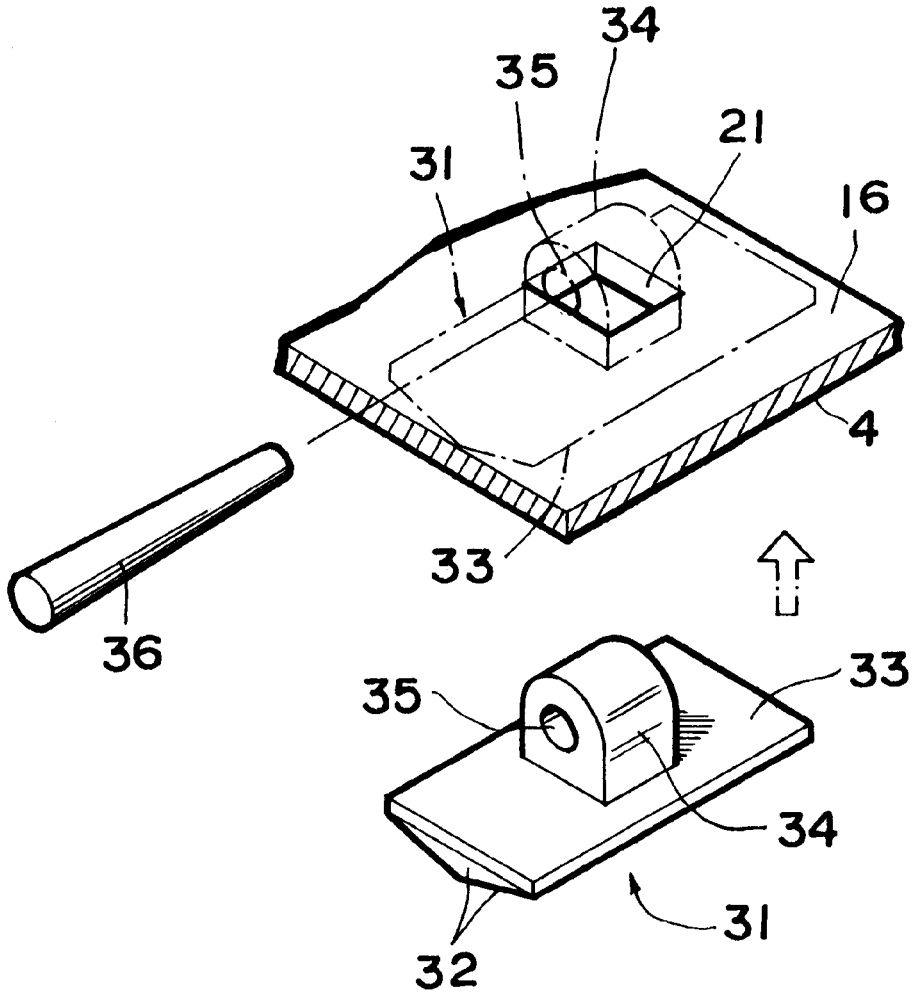
FIG. 3 is an exploded, partly cross-sectional perspective view showing the vicinity of the balance weight of the embodiment of the invention.

Hereinafter is explained an embodiment of a golf club of the invention with reference to FIG. 1 through FIG. 3.

Figure 4:
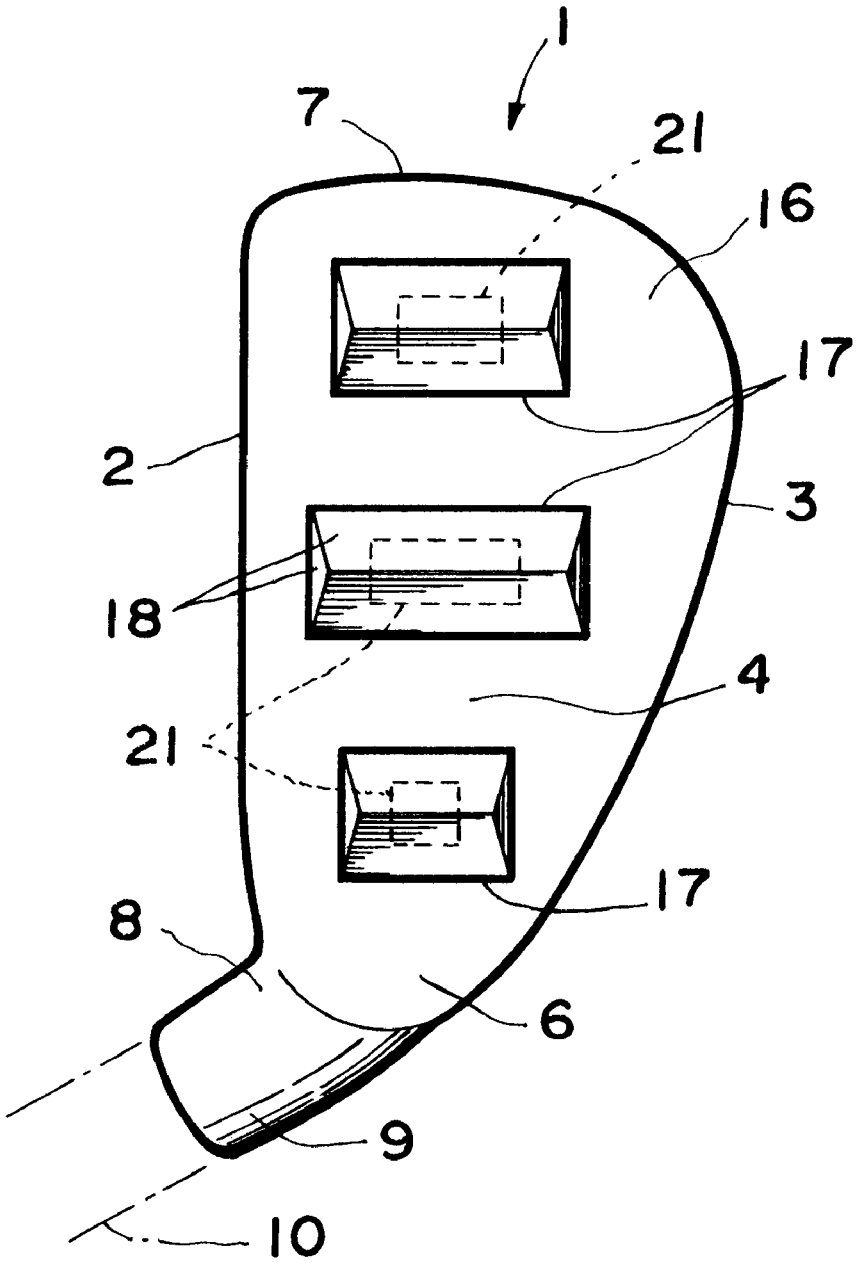
FIG. 4 is a bottom plan view showing a head of one example of a conventional golf club.
Figure 5:
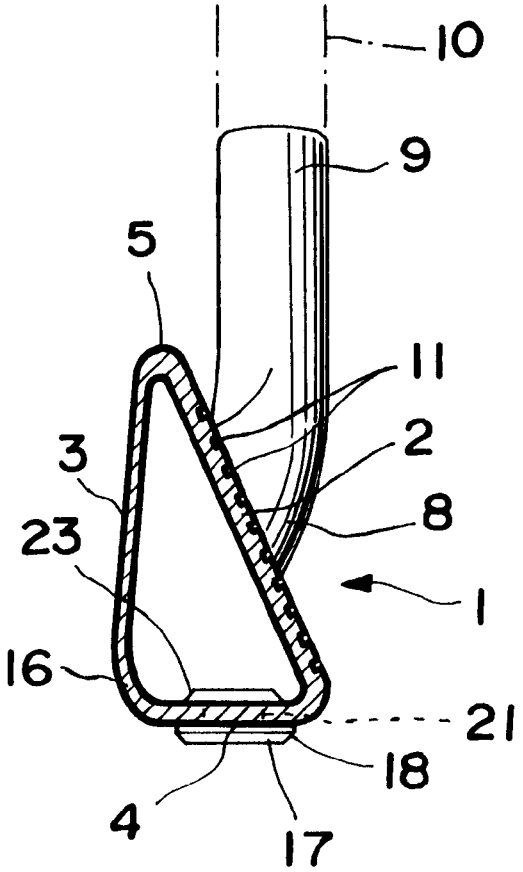
FIG. 5 is a section showing the head of FIG. 4.
Figure 6A:
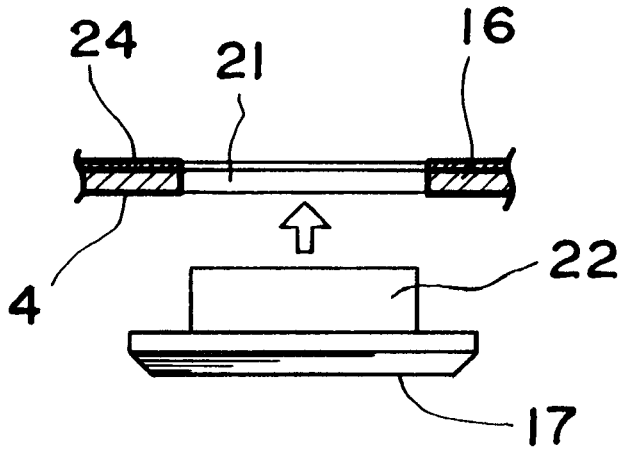
FIG. 6A is a section showing the vicinity of the balance weight of FIG. 4 prior to fixing the balance weight, while FIG. 6B a section thereof after fixing the balance weight.
Figure 6B:
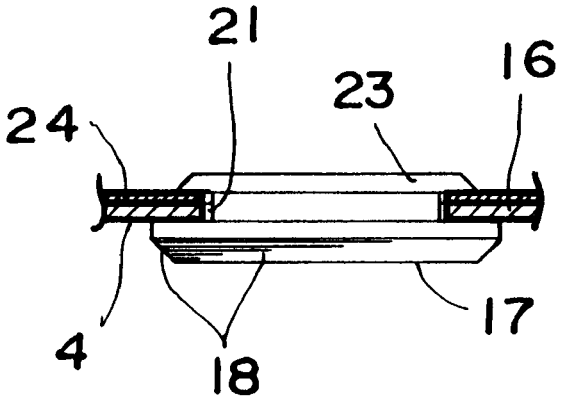

The head 1 of this embodiment has the same construction as that of the head 1 previously referred to with reference to FIG. 4 and FIG. 5, except a balance weight 31. Therefore, the descriptions of the common portions are omitted hereafter, attaching the same reference numerals thereto, respectively. Further, reference numerals indicated in FIGS. 4 and 5 are also quoted in the descriptions hereinbelow described.

In this embodiment, two or more balance weights 31 are fixed to the outside face of the sole 4 of the hollow head body 16, each projecting downward therefrom. Each balance weight 31 is formed slender, elongated in the back-to-front direction, and has beveled portions 32 on its lower all sides, in order to reduce a contacting area with the ground at the time of striking balls and lessen the resistance of the head 1 against the ground.

The material of each balance weight 31 is a metallic one, such as beryllium copper or tungsten-based one, having the specific gravity larger than that of the head body 16 which is made of iron-based or titanium-based one.

To fix each balance weight 31, there is each provided a projection 34 which is formed on the upper surface of a weight body 33. Through the projection 34 is nearly horizontally defined a weight through-hole 35. Thus, said projection 34 is inserted from the outside of the head body 16 into a through-hole 21 thereof which is vertically defined through the sole 4 portion of the outer shell of the head body 16, so that said weight through-hole 365 is located inside the head body 16. Thereafter, a taper pin 36 which is tapered and wedge-shaped, is pressed into the weight through-hole 35, so that the weight 31 is fixedly attached to the head body 16 with the same being anchored.

When manufacturing the head 1, the head body 16 is constructed by for example joining together a plurality of metallic plate members made by forging or the like, while said balance weights 31 are joined to one of the plate members which is to form the sole 4, prior to joining a plurality of metallic plate members. At the time of this joining process, the projection 34 of the weight 31 is inserted into the through-hole 21 of the head body 16, and then the taper pin 36 is inserted and pressed into the weight through-hole 35 of the projection 34. Thus, the taper pin 36 is pressingly contacted by both the weight through-hole 35 and the inner face of the sole 4 portion of the outer shell of the head body 16, whereby the sole 4 portion of the outer, hell is clamped between the weight body 33 of the weight 31 and the taper pin 36. As a result, the weight 31 is securely and rigidly fixed to the head body 16.

According to the foregoing embodiment, as the taper pin 36 is pressed into the weight through-hole 35 to thereby securely fix the weight 31 to the head body 16, there is no need of subjecting the balance weight 31 to plastic deformation by means of a press device or the like. Accordingly, unlike a conventional method where the weight 17 is fixed to the head body 16 by caulking the weight 17 itself, no extensibility is required of the material for the balance weight 31, and thus even the materials with less extensibility can be used as a material for the balance weight 31.

For example, tungsten-based materials which have the relatively large specific gravity but poor extensibility can be yet used for that purpose, without causing any problems. As a result, the limitations to the materials of the weight 31 are decreased, so that various types of materials can be used as a material for the balance weight 31. Further, despite its comparatively simple structure and easy assembling, the fixing strength of the weight 31 relative to the head body 16 is advantageously excellent.

As discussed previously, the balance weight 31 provided on the sole 4 aims at lowering the center of gravity of the whole head 1 so as to make struck balls easy to raise and elongate the travelling distances thereof. According to the embodiment of the invention, as the limitations to the materials useable for the material of the weight 31 are decreased, a greater degree of freedom is resulted with respect to the weight distribution of each portion of the head 1 in manufacturing the same. For example, a furthers lowering of the center of gravity is possible, using a material of the larger specific gravity such as tungsten-based ones.

Moreover, as the two or more balance weights 31 of the above structure are provided on only a partial area of the sole 4 portion of the outer shell of the head body 16, with the respective lower face beveled at all sides, the contact area with the ground can be decreased, thus resulting in the less resistance of the head with the ground.

Incidentally, the present invention should not be limited to the foregoing embodiment, but may be variously modified within a scope of the invention.

For example, although the head 1 was explained, taking an example of a long iron in the foregoing embodiment, the present invention is applicable to a hollow metallic head such as that of a wood club called metal wood. Further, although the balance weight 31 is provided in the sole 4 in the foregoing embodiment, it may be fixedly attached to other portions of the head, such as its back.

What is claimed:

1. A golf club incorporating a head having a shaft connected thereto and a face on a front, said head comprising:

a hollow head body, having an outer shell formed with a through-hole;

one or more balance weights to be securely fixed to an outer face of said head body, each having a projection formed therewith, said projection having a through-hole; and a taper wedge member provided for each balance weight, wherein said projection of the balance weight is inserted into said through-hole of the head body, and then said taper wedge member is pressed into the through-hole of said balance weight so as to securely fix the balance weight to the head body.

2. A golf club according to claim 1, wherein each balance weight is provided on a partial area of a sole of said head.

3. A golf club according to claim 2, wherein each balance weight is formed slender, extending from a front-to-back direction, having beveled portions at all sides of its bottom surface.

4. A golf club according to claim 1, wherein said through-hole of the balance weight is nearly horizontally formed.

5. A golf club according to claim 1, wherein each balance weight is formed of a tungsten-based material.

* * * * *

UNITED STATES PATENT AND TRADEMARK OFFICE

CERTIFICATE OF CORRECTION

PATENT NO. : 5,976,033

DATED : Nov. 2, 1999

INVENTOR(S) : Takeda

It is certified that error appears in the above-identified patent and that said Letters Patent is hereby corrected as shown below:

Col. 3, line 23, "outer, hell" should be -- outer shell --.

Col. 4, line 4, "furthers" should be -- further --.

Signed and Sealed this

Fifteenth Day of May, 2001

Nicholas P. Godici

*Attest:*

NICHOLAS P. GODICI

*Attesting Officer*

*Acting Director of the United States Patent and Trademark Office*